United States Patent [19]

Fujimura

[11] Patent Number: 4,540,064

[45] Date of Patent: Sep. 10, 1985

[54] NOISE AND VIBRATION REDUCING APPARATUS FOR USE IN EXHAUST SYSTEM OF ENGINE

[75] Inventor: Ryuta Fujimura, Higashiyamato, Japan

[73] Assignee: Nissan Motor Co., Ltd., Yokohama, Japan

[21] Appl. No.: 468,406

[22] Filed: Feb. 22, 1983

[30] Foreign Application Priority Data

Mar. 17, 1982 [JP] Japan ..... 57-41922

[51] Int. Cl.[3] ..... F01N 1/02

[52] U.S. Cl. ..... 181/227; 181/255; 181/272; 181/273

[58] Field of Search ..... 181/227, 228, 243, 247–250, 181/255, 264–266, 276

[56] References Cited

U.S. PATENT DOCUMENTS

| | | | |
|---|---|---|---|
| 1,909,394 | 5/1933 | Dodge | 181/249 |
| 3,682,270 | 8/1972 | Haren | 181/266 |
| 4,315,558 | 2/1982 | Katayama | 181/255 X |
| 4,361,206 | 11/1982 | Tsai | 181/255 |

*Primary Examiner*—Benjamin R. Fuller

[57] ABSTRACT

A flexible means is interposed between a first exhaust conduit fixed to the power unit of an automobile and a second conduit elastically supported by the automobile body, and conveys the exhaust gases of the power unit from the first exhaust conduit to the second exhaust conduit. The flexible means has a first end portion fixed to the first exhaust conduit and a second end portion fixed to the second exhaust conduit. The flexible means further has a middle portion which is a bellows which extends between and is bounded by the first and second end portions to form an expansion chamber therebetween. The chamber is fluidly connected with the first exhaust conduit and the second exhaust conduit.

1 Claim, 5 Drawing Figures

NOISE AND VIBRATION REDUCING APPARATUS FOR USE IN EXHAUST SYSTEM OF ENGINE

BACKGROUND OF THE INVENTION

The present invention relates to a noise and mechanical vibration reducing apparatus generally used as a pre-muffler in an exhaust system of an internal combustion engine.

In an exhaust system of an automobile, there is provided, at an exhaust pipe, a flexible tube. The flexible tube serves to prevent vibrations caused by the power unit from being transmitted through the exhaust pipe and producing noises by vibrating heat shields installed at the undersides of the exhaust pipe and other exhaust system members.

In such a flexible tube, exhaust gases having a high temperature and a high pressure flow near the corrugated inner surface of the flexible tube and form many vortexes which produce noises such as whistling noise. This result is undesirable.

SUMMARY OF THE INVENTION

It is an object of the present invention to provide a noise and vibration reducing apparatus which serves as both a flexible tube and a muffler.

According to the present invention, the noise and vibration reducing apparatus for use in an exhaust system of an automobile power unit, comprises a first exhaust conduit, a second exhaust conduit and flexible means. The first exhaust conduit is fixed to the power unit and conducts the exhaust gases from the power unit. The second exhaust conduit is elastically supported by the automobile body and serves to vent the exhaust gas. The flexible means is interposed between the first and second exhaust conduits, and has a first end portion fixed to the first exhaust conduit, a second end portion fixed to the second exhaust conduit and a hollow middle portion. The middle portion extends between and is bounded by the first and second end portions to form a chamber therebetween. The chamber communicates with the first and second exhaust conduits. According to the present invention, the middle portion is a bellows.

DETAILED DESCRIPTION OF THE INVENTION

Figure 1:
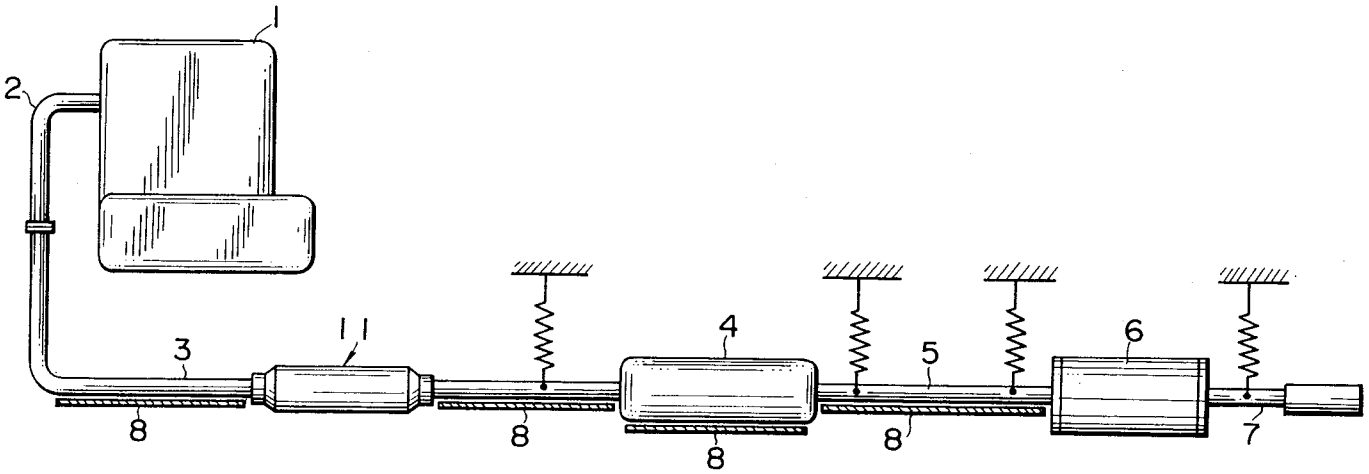
PRIOR ART FIG. 1
FIG. 1 is a front view of a conventional type exhaust system.
Figure 2:
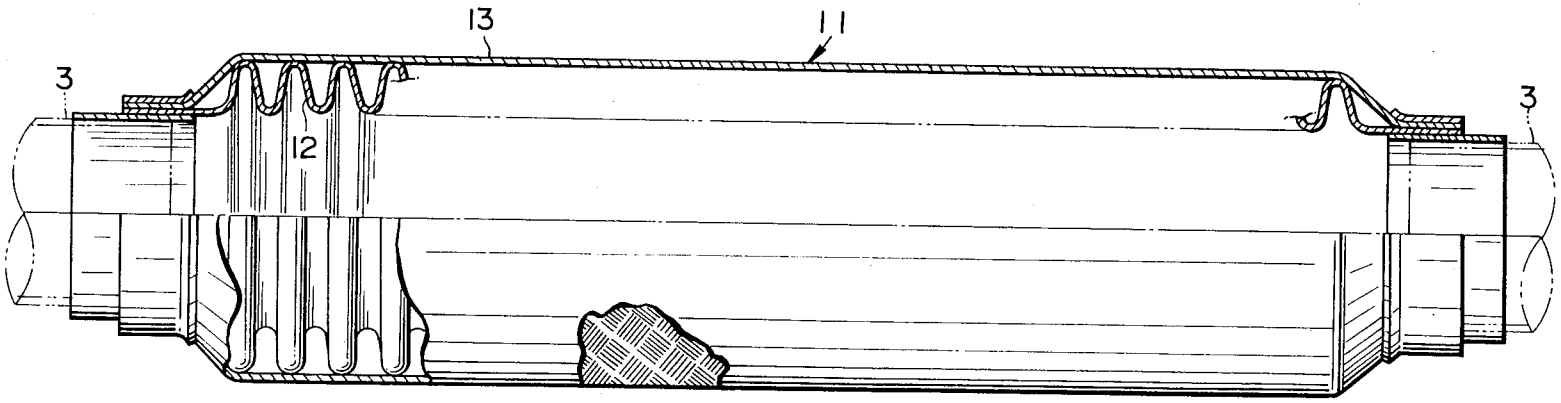
PRIOR ART FIG. 2
FIG. 2 is a schematic sectional view of a flexible tube of the exhaust system of FIG. 1.

In FIG. 1 which shows a conventional type exhaust system, a power unit 1 has an exhaust manifold 2. The exhaust manifold is connected to an assembly of a front exhaust pipe 3, a catalytic converter 4, a center exhaust pipe 5, a muffler 6 and a tailpipe 7. This assembly is elastically suspended from a vehicle body. A flexible tube 11 is interposed in the front pipe 3 for preventing transmission of vibrations. Heat shields 8 are installed at the undersides of the front pipe 3, the catalytic converter 4 and the center pipe 5, respectively. The flexible tube 11 is shown in FIG. 2. A bellows tube 12 for conducting high temperature exhaust gases has a corrugated sectional shape and is capable of expanding and contracting. The bellows tube 12 is covered and protected by a braided wire 13.

When the exhaust gases having a high temperature and a high pressure flow through this bellows tube 12 of the flexible tube 11, the corrugated inner surface of the bellows tube 12 causes vortexes, which produce whisting noise.

Figure 3:
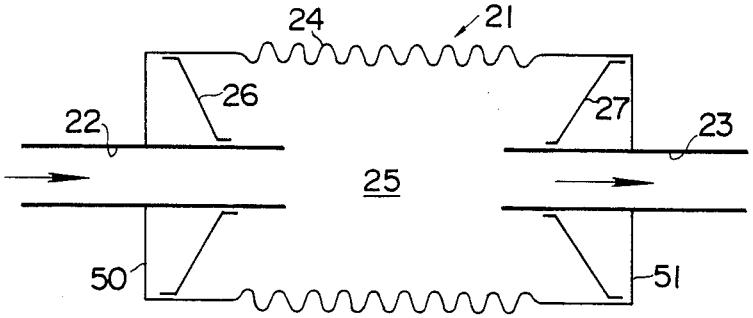
FIG. 3 is a schematic illustration showing one embodiment of the noise and vibration reducing apparatus according to the present invention.

One embodiment of the present invention is shown in FIG. 3. In FIG. 3, a premuffler 21 has a first end 50 which fluidly communicates with and is fixed to a first exhaust conduit 22, and a second end 51 which fluidly communicates with and is fixed to a second exhaust conduit 23. A bellows portion 24 extends between the first and second ends of the premuffler 21. The bellows portion 24 has a corrugated sectional shape and is capable of expanding and contracting. The first exhaust conduit 22 is fixed to the power unit, and the second exhaust conduit 23 is elastically supported by the vehicle body. The premuffler 21 has therein a muffler or expansion chamber 25 which is defined by the bellows portion 24 and has a larger diameter than the first and second exhaust conduit 22 and 23. The first and second exhaust conduit 22 and 23 project into the expansion chamber 25. Reinforcing members 26 and 27 support the first and second exhaust conduit 22 an 23, respectively. It is preferable that the inner diameter of the expansion chamber 25 is two to four times as large as the inner diameter of the first exhaust conduit 22.

When exhaust gases of a high temperature and a high pressure flows into the expansion chamber 25 from the first exhaust conduit 22, the gases expand abruptly in the expansion chamber 25 and the pressure of the gases decreases. Therefore, the velocity of the exhaust gas flow near the inner surface of the bellows portion 24 is reduced, so that this premuffler 21 can prevent occurrences of vortexes and whistling noise, and at the same time reduce the exhaust noise of the power unit. Then, the exhaust gases flows from the expansion chamer 25 into the second exhaust conduit 23. The premuffler 21 retains its function as a flexible tube. The bellows portion 24 damps the vibrations transmitted from the power unit through the first exhaust conduit 22, and isolates the second exhaust conduit 23, so that the premuffler 21 can prevent noises of the heat shields on the downstream side of the premuffler 21.

Figure 4:
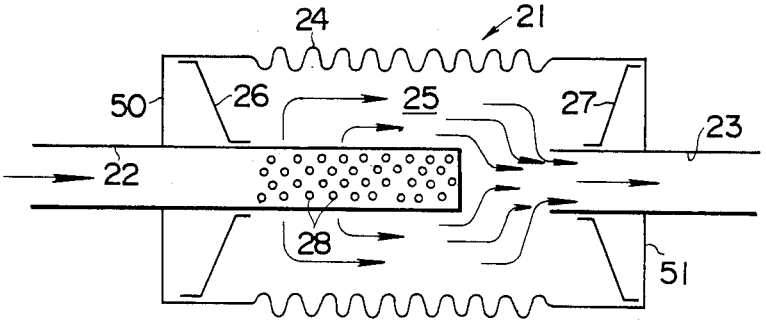
FIG. 4 is a schematic illustration showing another embodiment of the present invention.

Another embodiment of the present invention is shown in FIG. 4. In this embodiment, the first exhaust conduit 22 has a downstream end portion which is inserted in the expansion chamber 25 and formed with a plurality of small perforations 28. The exhaust gas in the first exhaust conduit 22 is allowed to flow into the expansion chamber 25 through the perforations 28. As shown by arrows in FIG. 3, the exhaust gas flows into the expansion chamber 25 through the perforations 28 with lowering of its temperature and pressure, and then the cooled and expanded exhaust gas flows out into the second exhaust conduit 23. This arrangement further reduces the exhaust gas velocity near the corrugated inner surface of the bellows portion 24 to prevent the whistling noise, and at the same time, silences the exhaust noise of the power unit more efficiently.

Figure 5:
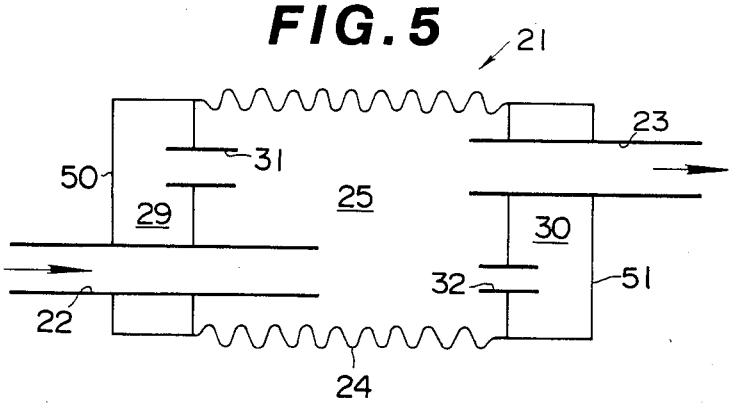
FIG. 5 is a schematic illustration showing still another embodiment of the present invention.

Still another embodiment of the present invention is shown in FIG. 5. In this embodiment, there are formed resonance chambers 29 and 30 on both sides of the expansion chamber 25. The resonance chambers 29 and 30 fluidly communicate with the expansion chamber 25 by means of communication passages 31 and 32, respectively. This arrangement efficiently reduces the level of the exhaust noise of the power unit having a specific frequency, so that the efficiency of the silencer is further improved.

What is claimed is:

1. A noise and vibration reducing apparatus for use in an exhaust system of an automobile power unit, comprising:

a cylindrical first exhaust conduit, fixed to the power unit, for conducting the exhaust gases from the power unit;

a second exhaust conduit, elastically supported by the body of the automobile, for venting the exhaust gases, and, flexible means interposed between said first and second exhaust conduits and having a first end portion fixed to said first exhaust conduit, a second end portion fixed to said second exhaust conduit and a hollow middle portion extending between and being bounded by said first and second end portions to form therebetween a cylindrical expansion chamber which communicates with said first and second exhaust conduits, said middle portion consisting of a flexible bellows capable of expanding and contracting and capable of preventing vibration from being transmitted between said first and second exhaust conduits, the inner diameter of said middle portion being two to four times as large as the inner diameter of said first exhaust conduit, each of said first and second end portions forming a resonance chamber communicating respectively with said expansion chamber.

* * * * *